US008245549B2

(12) United States Patent
Zagoroff

(10) Patent No.: US 8,245,549 B2
(45) Date of Patent: Aug. 21, 2012

(54) TAMPERPROOF POWER TAILGATE LOCK

(75) Inventor: Dimiter S. Zagoroff, Lincoln, MA (US)

(73) Assignee: Pop & Lock, LLC, Green Bay, WI (US)

( * ) Notice: Subject to any disclaimer, the term of this patent is extended or adjusted under 35 U.S.C. 154(b) by 255 days.

(21) Appl. No.: 12/583,964

(22) Filed: Aug. 27, 2009

(65) Prior Publication Data

US 2010/0050708 A1 Mar. 4, 2010

Related U.S. Application Data

(60) Provisional application No. 61/092,221, filed on Aug. 27, 2008.

(51) Int. Cl.
*E05B 47/06* (2006.01)

(52) U.S. Cl. ..... 70/283; 70/208; 70/237; 70/279.1; 292/336.3; 292/144; 292/201; 292/DIG. 23; 292/DIG. 43

(58) Field of Classification Search ..... 70/208, 70/237, 264, 279.1, 283; 292/336.3, 144, 292/201, 216, DIG. 23, DIG. 29, DIG. 42, 292/DIG. 43

See application file for complete search history.

(56) References Cited

U.S. PATENT DOCUMENTS

| | | | | | |
|---|---|---|---|---|---|
| 5,174,619 | A * | 12/1992 | Bender et al. | ..... | 292/336.3 |
| 5,295,374 | A * | 3/1994 | Bender et al. | ..... | 70/208 |
| 5,642,636 | A * | 7/1997 | Mitsui | ..... | 70/237 |
| 5,829,799 | A * | 11/1998 | Yamagishi et al. | ..... | 292/201 |
| 5,852,943 | A * | 12/1998 | Dutka et al. | ..... | 70/237 |
| 6,192,725 | B1 * | 2/2001 | Watson et al. | ..... | 70/208 |
| 6,343,494 | B2 * | 2/2002 | Roos et al. | ..... | 70/264 |
| 7,140,651 | B2 * | 11/2006 | Brose | ..... | 292/216 |
| 7,258,373 | B2 * | 8/2007 | Plett et al. | ..... | 292/210 |
| 2007/0120382 | A1 * | 5/2007 | Chevalier | ..... | 292/336.3 |

* cited by examiner

*Primary Examiner* — Suzanne Barrett
(74) *Attorney, Agent, or Firm* — Joseph S. Heino; Patrick M. Bergin

(57) ABSTRACT

A tamperproof power lock is provided for use in a pickup truck tailgate latch handle. The lock includes a power actuator, a rotating crank, a connecting rod and a lock bolt that locks the tailgate handle. The linear output motion of the actuator is transferred into rotation of the crank that is limited to rotate between two stops. An over center spring or friction keeps the crank or the lock bolt in either of the two stop positions. The rotation of the crank is transferred into linear motion of the locking bolt by the connecting rod. In the locked position the crank is up against one of the stops and the connecting rod past dead center. As a result the locking bolt cannot be pushed back forcibly in an attempt to defeat the lock.

15 Claims, 3 Drawing Sheets

TAMPERPROOF POWER TAILGATE LOCK

RELATED APPLICATION

This application claims the benefit of U.S. Provisional Application No. 61/092,221, filed on Aug. 27, 2008 the entire teachings of that are incorporated herein by reference

FIELD OF INVENTION

This invention relates to electrically powered locks. Specifically, it relates to a power lock for the tailgate of a pick up truck.

BACKGROUND OF THE INVENTION

Heretofore electrical actuators employed in locking the tailgate of trucks have been mounted in such a manner, that the linear motion of the internal rack and pinion mechanism is directly coupled to the sliding motion of the locking bolt. The locking bolt can be easily pushed back by hand once the power to the actuator is switched off since the pinion of the motor offers little resistance to movement of the rack.

As a result, one limitation of existing power locks is that they can be defeated easily by reaching through the gap between the plastic trim piece and the tailgate handle and pushing the locking bolt out of the way by hand or using a tool such as a common screw driver.

The need exists, therefore, for a tamper proof power lock

SUMMARY OF THE INVENTION

The present invention comprises a power actuator, a rotating crank, a connecting rod and a locking bolt. The linear output motion of the actuator is transferred into rotation of the crank that is limited to rotate between two stops. An over center spring biases the crank in either of the two end positions. The rotation of the crank is transferred into linear motion of the locking bolt by the connecting rod. In the locked or fully extended position the crank is up against one of the stops just past its dead center. As a result the locking bolt cannot be pushed back forcibly in an attempt to defeat the lock.

The primary object and advantage of my invention is to provide a power lock with a locking lock bolt that can be moved to and fro by an internal linear actuator but not by any external forces when it is in the extended position.

A further object and advantage of my invention is to provide a tamperproof power lock that cannot be reset from the outside.

Still further objects and advantages will become apparent from a consideration of the ensuing description and accompanying drawings.

DESCRIPTION OF THE INVENTION

Figure 1A:
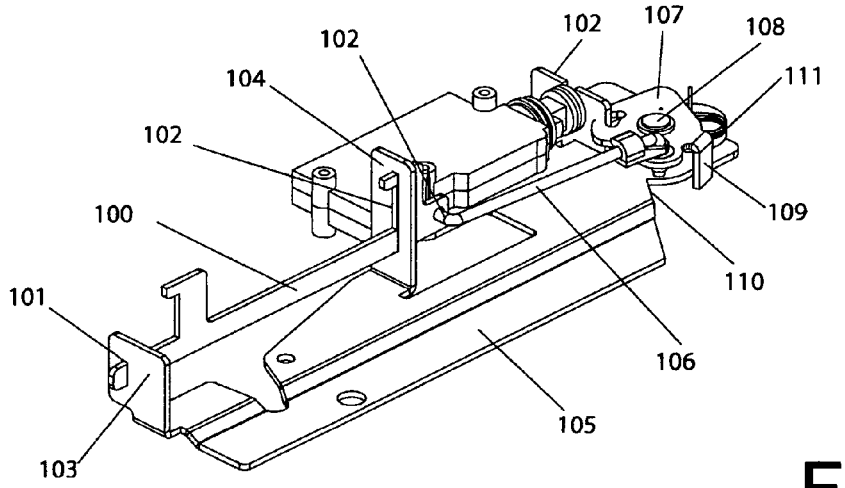
FIG. 1A is an overall perspective view of a preferred embodiment prior to installation with the cover removed for clarity.
Figure 1B:
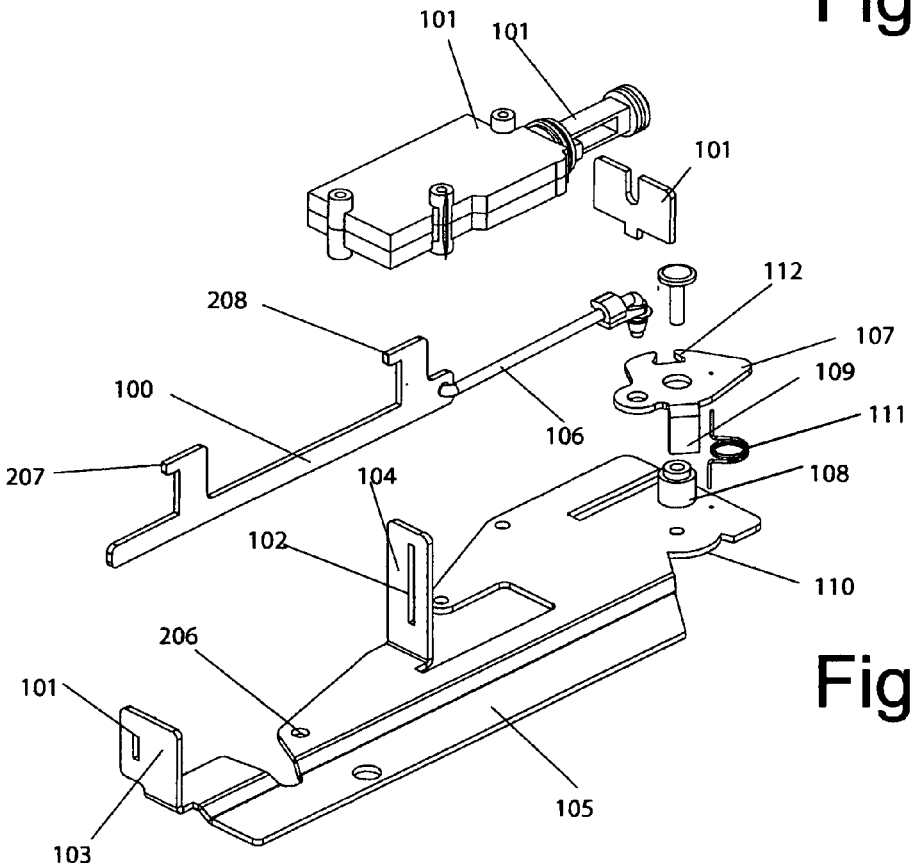
FIG. 1B shows the preferred embodiment in the same perspective but in an exploded view to illustrate the various elements.

Referring to FIGS. 1A and 1B, one embodiment of the present invention comprises a locking bolt 100 which is mounted movably in slots 101 and 102 on the flanges 103 and 104 of a bracket 105. The position of the locking bolt 100 is controlled by the connecting rod 106 which attaches to the locking bolt 100 at one end and to a crank 107 at the other end. Crank 107 pivots on a post 108 in bracket 105 and carries a pawl 109 which rotates inside a sector 110 of the bracket 105. The sector 110 limits the angle of rotation of the crank 107. A spring 111 is mounted between the bracket 105 and the crank 107 in such a fashion that it biases the crank 107 either to one or the other end positions of the sector 110. The crank 107 can also be retained in place by the friction, for example by a wave washer (not shown) instead of spring loading, The linear power actuator 115 has to be strong enough to overcome either the friction or the spring loading. The crank 107 has a slot 112 which engages a rack driver 113 attached to the output rod 114 of a linear power actuator 115 that is mounted on the bracket 105. The rack driver 113 and slot 112 function in the fashion of a "rack and pinion" to convert the linear motion of the output rod 114 into rotation of the crank, however the slot 112 may be sized to permit enough lost motion to allow the output rod 114 to return to a neutral position when the linear power actuator 115 is de-energized.

Figure 2:
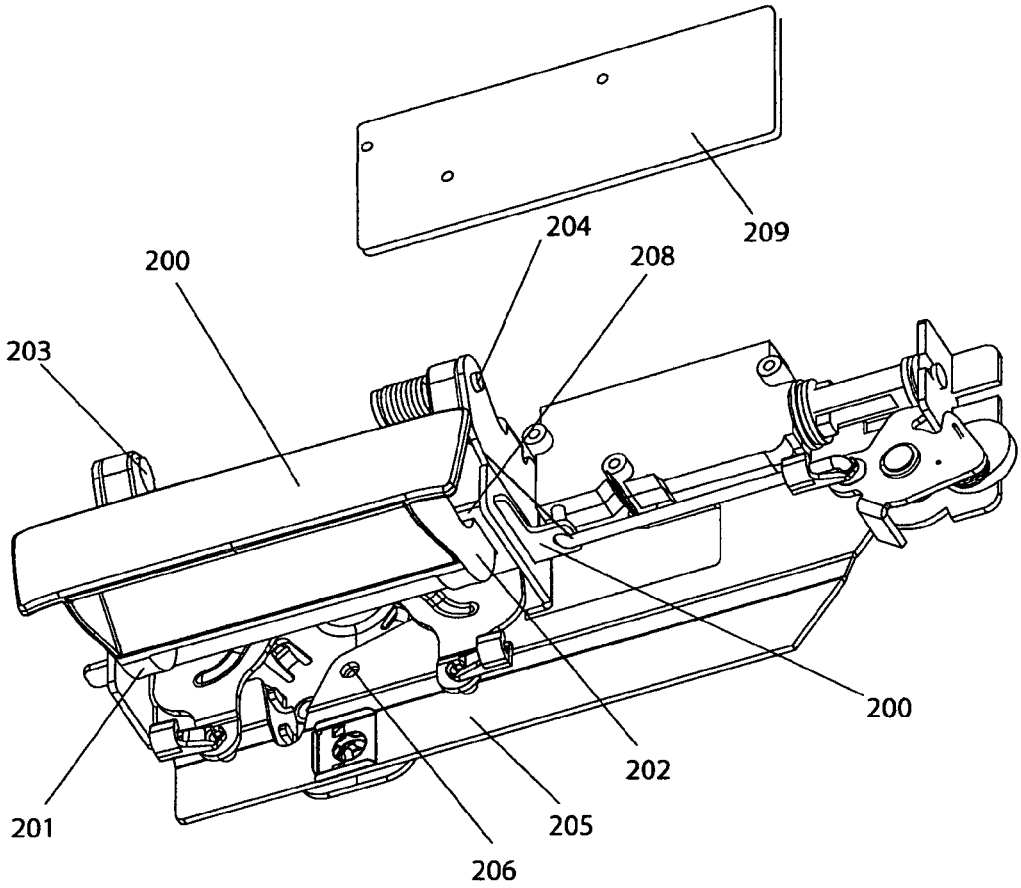
FIG. 2 is an overall perspective view of the preferred embodiment installed on the handle mechanism with the cover raised for clarity.

Referring to FIG. 2, the typical tailgate latching handle comprises a handle 200 hinging on arms 201 and 202 about pivots 203 and 204 on a handle bracket 205. The power lock described above is mounted to the handle bracket 205 by a fastener through the mounting hole 206 in such a fashion, that the hooks 207 and 208 of the locking bolt 100 hook over the arms 201 and 202 when the locking bolt 100 is in the extended position. A cover plate 209 mounts on top of the actuator 115 to shield the mechanism from tampering from the outside.

Figure 3A:
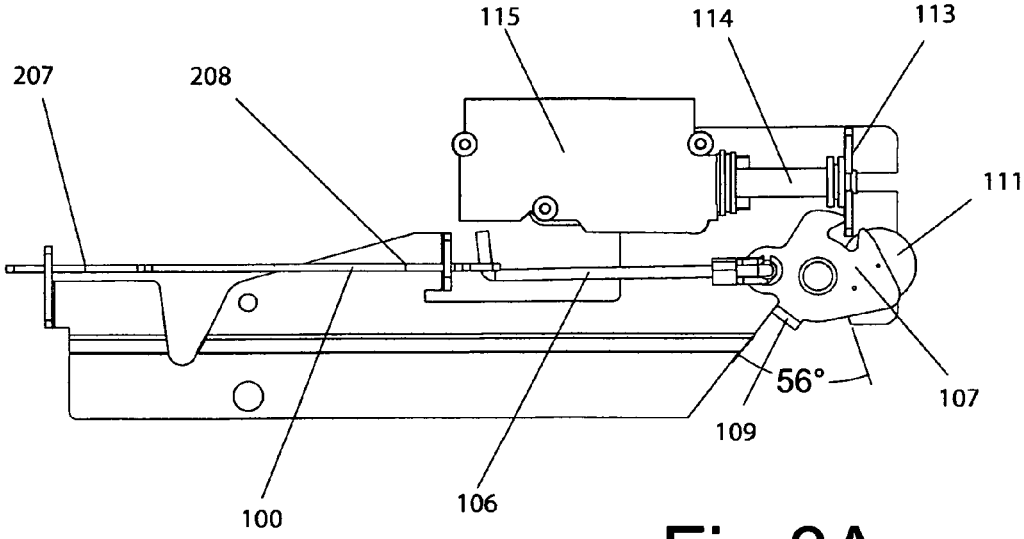
FIGS. 3 A-B is a plan view of the preferred embodiment in the "locked" and "unlocked" positions respectively with the cover removed for clarity.

FIG. 3A is a plan view of the preferred embodiment in the "locked" position to illustrate its operation. When powered by an electrical pulse, the actuator 115 extends the output rod 114 and the driver 113 which turns the crank 107 clockwise until the pawl 109 stops at one end of the sector 110 shown to have 56 degrees travel. The rotation of the crank 107 is transferred to linear motion of the locking bolt 100 by the connecting rod 106. Note that the sector 110 is sized in such a fashion that the connecting rod 106 travels past dead center to a small angle such as 5 degrees before coming to a stop. Also note that spring 111 biases the linkage to rest against this stop.

As also shown in FIGS. 1A and 2, the hooks 207 and 208 of the locking bolt 100 hook over the arms 201 and 202 of the handle 200 and lock its motion when the locking bolt 100 is in this extended position. Note that any attempt to push the locking bolt 100 back by outside means is foiled as the crank 107 is past dead center and any forcible push to unlock the handle 200 only drives the pawl 109 more firmly against the stop established by the sector 110. As a result, this mechanism is inherently tamperproof. A protective cover 209 can be installed to further shield the mechanism against any tampering.

Figure 3B:
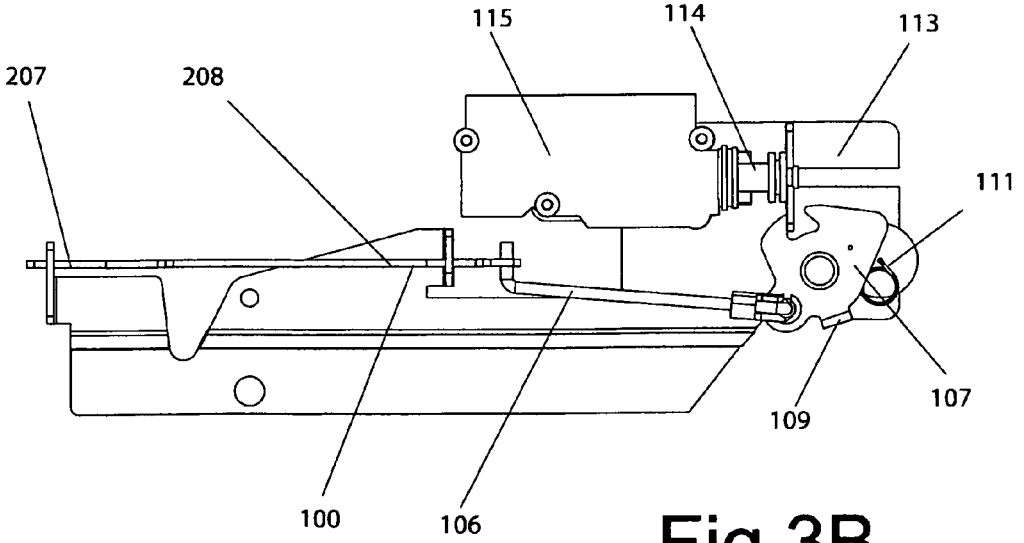

FIG. 3B shows the preferred embodiment in the "unlocked" position. When powered by an electrical pulse of the opposite polarity, the power actuator 115 retracts the output rod 114 as well as the driver 113 which turns the crank 107 counter-clockwise until the pawl 109 stops at the other end of the sector. The connecting rod 106 retracts and slides the locking bolt 100 into the "unlock" position.

While this invention has been particularly shown and described with references to example embodiments thereof, it will be understood by those skilled in the art that various changes in form and details may be made therein without departing from the scope of the invention encompassed in the appended claim.

Thus, for instance, the spring loading or friction applied between the crank 107 and the bracket 105 can be applied instead between the locking bolt 100 and the bracket 105.

The invention claimed is:

1. A power lock for a tailgate latching handle comprising:

an electrically powered reciprocal linear actuator comprising an output rod and a rack driver, the linear motion of the rack driver being transferable to the rotation of a crank; and a connecting rod that converts the crank rotation into sliding motion of a locking bolt;

wherein the connecting rod travels past dead center when the actuator is fully extended and wherein the rotation of the crank is limited by a stop past dead center thereby preventing movement of the connecting rod in a direction toward the stop.

2. The power lock of claim 1 wherein the locking bolt has one or more hooks that lock the handle when the reciprocal linear actuator is energized.

3. The power lock of claim 1 wherein the crank or the locking bolt are spring loaded in the "locked" or "unlocked" positions.

4. The power lock of claim 1 wherein the crank or the locking bolt are retained in the "locked" or "unlocked" positions by friction.

5. The power lock of claim 1 wherein the electrically powered reciprocal linear actuator is coupled to the locking bolt with sufficient lost motion to allow the crank to return to a neutral position while the locking bolt remains locked or unlocked.

6. A power lock for a tailgate latch handle comprising:

a bracket, the bracket comprising a sector, the sector comprising a first stop portion and a second stop portion;

a crank attached to the bracket, the crank further comprising a pawl;

a linear actuator attached to the crank; and a locking bolt having a first end attached to the crank;

wherein the crank is rotatable by energizing the linear actuator past dead center to a first locked position wherein the pawl contacts the first stop portion of the sector thereby preventing motion of the locking bolt in a direction toward the first stop portion.

7. The power lock of claim 6 further comprising a spring operable to bias the crank towards the first stop portion of the sector.

8. The power lock of claim 6 wherein the linear power actuator can be energized to rotate the crank to an unlocked position.

9. The power lock of claim 8 wherein the pawl contacts the second stop portion of the sector in the unlocked position.

10. The power lock of claim 6 wherein the linear power actuator further comprises an output rod and a rack driver and the crank further comprises a slot for the rack driver and the slot provides for sufficient lost motion such that the connecting rod can return to a neutral position when the linear power actuator is de-energized.

11. A power lock for a tailgate latch handle comprising:

a bracket, the bracket comprising a sector, the sector comprising a first stop portion and a second stop portion;

a crank attached to the bracket, the crank further comprising a pawl;

a linear actuator attached to the bracket, the linear actuator comprising an output rod and a rack driver;

a connecting rod having a first end attached to the crank and a second end; and a locking bolt attached to the second end of the connecting rod;

wherein the crank is rotatable by energizing the linear actuator to extend the connecting rod and the locking bolt past dead center to a first locked position wherein the pawl contacts the first stop portion of the sector thereby preventing movement of the locking bolt in a direction of toward the first stop portion.

12. The power lock of claim 11 further comprising a spring operable to bias the crank towards the first stop portion of the sector.

13. The power lock of claim 11 wherein the linear power actuator can be energized to rotate the crank to an unlocked position.

14. The power lock of claim 13 wherein the pawl contacts the second stop portion of the sector in the unlocked position.

15. The power lock of claim 11 wherein the linear power actuator further comprises an output rod and a rack driver and the crank further comprises a slot for the rack driver and the slot provides for sufficient lost motion such that the connecting rod can return to a neutral position when the linear power actuator is de-energized.

* * * * *